US010842285B1

(12) United States Patent
Glass

(10) Patent No.: US 10,842,285 B1
(45) Date of Patent: Nov. 24, 2020

(54) LEG PILLOW

(71) Applicant: Michael Charles Glass, Renton, WA (US)

(72) Inventor: Michael Charles Glass, Renton, WA (US)

( * ) Notice: Subject to any disclaimer, the term of this patent is extended or adjusted under 35 U.S.C. 154(b) by 0 days.

(21) Appl. No.: 16/854,042

(22) Filed: Apr. 21, 2020

(51) Int. Cl.
*A47C 20/00* (2006.01)
*A47G 9/10* (2006.01)

(52) U.S. Cl.
CPC ..... *A47C 20/021* (2013.01); *A47G 9/10* (2013.01); *A47G 9/109* (2013.01); *A47G 9/1027* (2013.01); *A47G 9/1045* (2013.01); *A47G 9/1054* (2013.01); *A47G 9/1063* (2013.01); *A47G 9/1072* (2013.01); *A47G 9/1081* (2013.01); *A47G 2009/1018* (2013.01)

(58) Field of Classification Search
CPC ..... A47C 20/021; A47G 9/10; A47G 9/1027; A47G 9/1045; A47G 9/1054; A47G 9/1063; A47G 9/1072; A47G 9/1081; A47G 9/109; A47G 2009/1018
See application file for complete search history.

(56) References Cited

U.S. PATENT DOCUMENTS

| | | | | |
|---|---|---|---|---|
| 5,134,739 | A * | 8/1992 | Gaffe | A61G 7/0755 5/624 |
| 5,289,828 | A * | 3/1994 | Toth | A47C 20/021 128/DIG. 20 |
| 6,032,669 | A * | 3/2000 | Klein | A47C 20/021 128/845 |
| 8,156,941 | B1 * | 4/2012 | Simms | A47C 20/021 128/845 |
| 8,214,952 | B2 * | 7/2012 | Beasley | A61F 5/0193 5/630 |
| 9,301,868 | B2 * | 4/2016 | Castle | A61G 7/0755 |
| 2003/0182727 | A1 * | 10/2003 | DuDonis | A61G 7/0755 5/648 |
| 2009/0229056 | A1 * | 9/2009 | Edinger | A47C 20/021 5/648 |
| 2013/0291308 | A1 * | 11/2013 | Kiefer | A47C 20/027 5/652.1 |
| 2015/0208812 | A1 * | 7/2015 | Fenton | A47G 9/10 5/632 |
| 2015/0250326 | A1 * | 9/2015 | Riccabona | A47C 20/021 5/636 |
| 2017/0165138 | A1 * | 6/2017 | McCoy | A47C 16/025 |

* cited by examiner

*Primary Examiner* — Robert G Santos
*Assistant Examiner* — Rahib T Zaman
(74) *Attorney, Agent, or Firm* — Brubaker Law Group PLLC

(57) ABSTRACT

A pillow specially shaped to support a user sleeping in multiple positions that can allow the user to easily transit from one position to another. Accessories to the pillow may also provide convenience and comfort to the user.

6 Claims, 15 Drawing Sheets

LEG PILLOW

TECHNICAL FIELD

The present application relates to sleeping aids, and more specifically to a leg pillow.

BACKGROUND

The present application relates to pillows designed to aid with sleeping. Certain sleeping positions inhibit circulation, which can disrupt sleep or make falling asleep more difficult. The present invention

SUMMARY OF THE INVENTION

The present application discloses a leg pillow to aid with sleeping.

DETAILED DESCRIPTION

In the Summary above and in this Detailed Description, and the claims below, and in the accompanying drawings, reference is made to particular features of the invention. It is to be understood that the disclosure of the invention in this specification includes all possible combinations of such particular features. For example, where a particular feature is disclosed in the context of a particular aspect or embodiment of the invention, or a particular claim, that feature can also be used—to the extent possible—in combination with and/or in the context of other particular aspects and embodiments of the invention, and in the invention generally The term "comprises" and grammatical equivalents thereof are used herein to mean that other components, ingredients, steps, etc. are optionally present. For example, an article "comprising" (or "which comprises") components A, B, and C can consist of (i.e., contain only) components A, B, and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range including that number (which may be a range having an upper limit or no upper limit, depending on the variable being defined). For example, "at least 1" means 1 or more than 1. The term "at most" followed by a number is used herein to denote the end of a range, including that number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)-(a second number)," this means a range whose limits include both numbers. For example, "25 to 100" means a range whose lower limit is 25 and upper limit is 100, and includes both 25 and 100.

Figure 1:
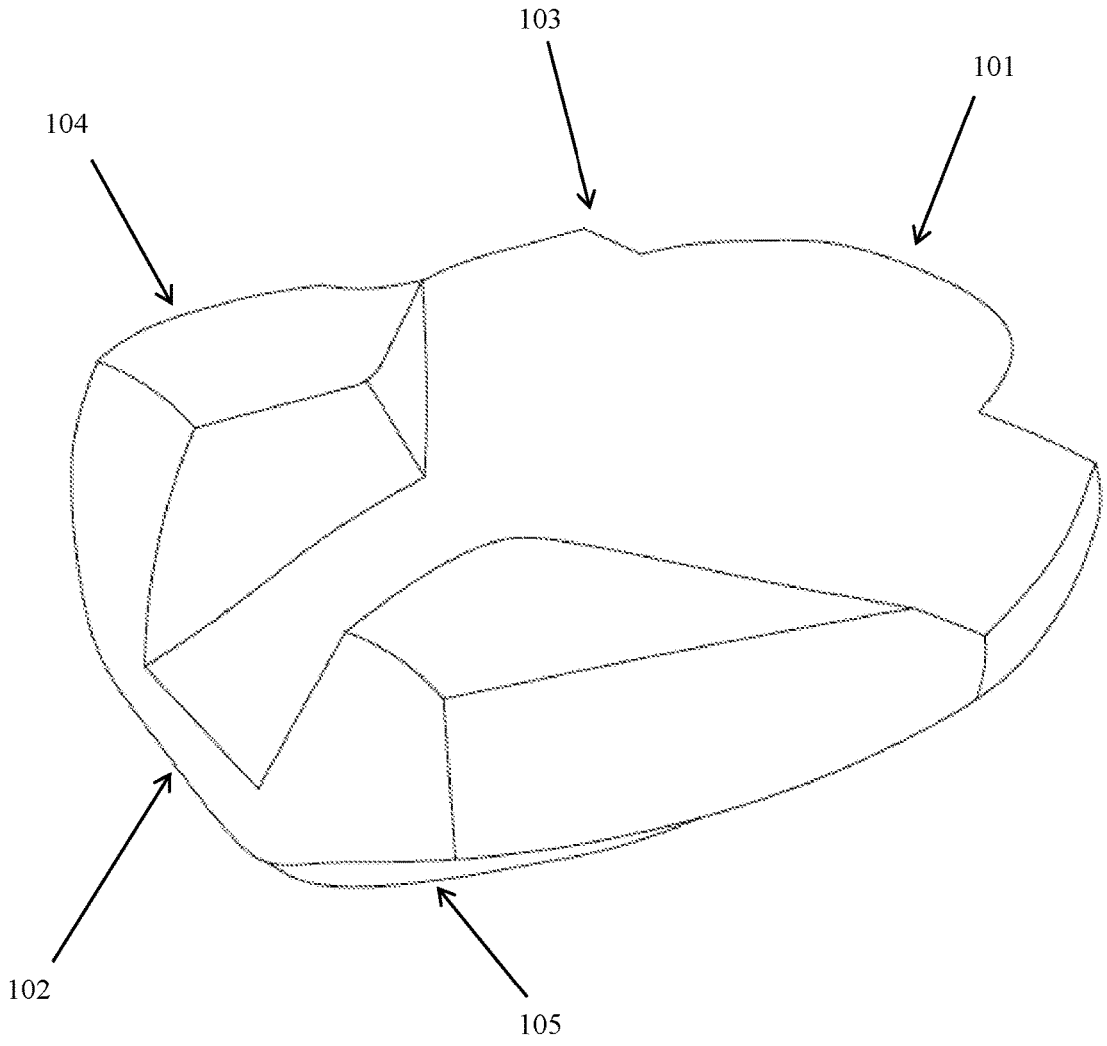
FIG. 1 is a perspective view of the top and side.
Figure 2:
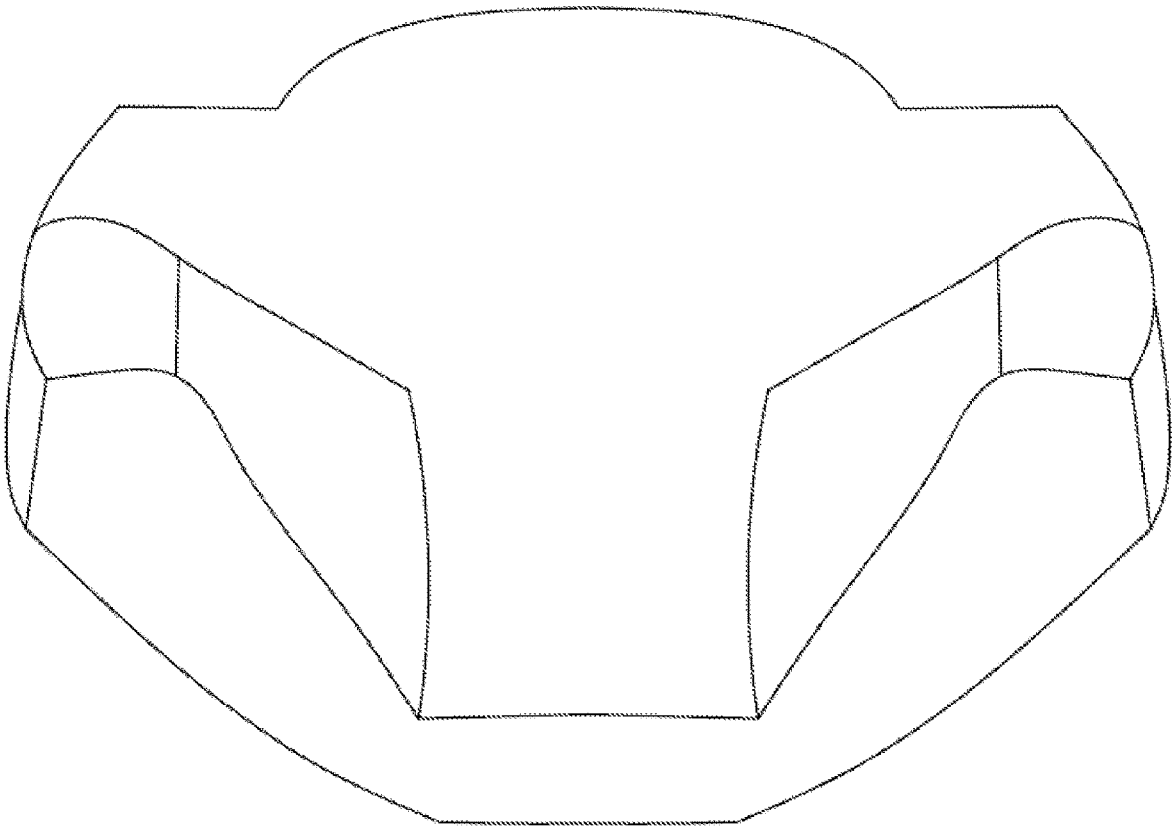
FIG. 2 is a perspective view of the proximal side and top.
Figure 3:
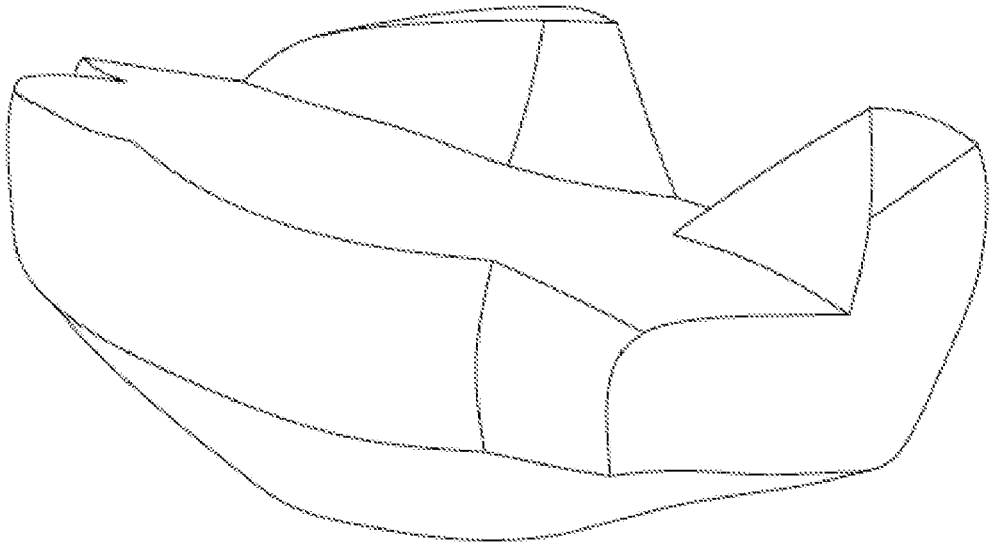
FIG. 3 is a perspective view of the distal side.
Figure 4:
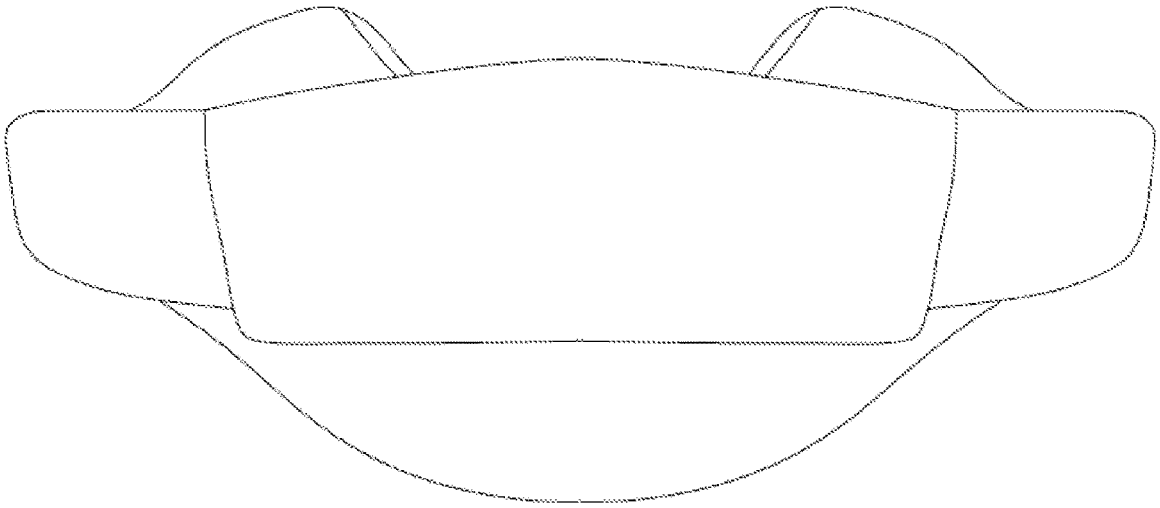
FIG. 4 is a view of the distal side.
Figure 9:
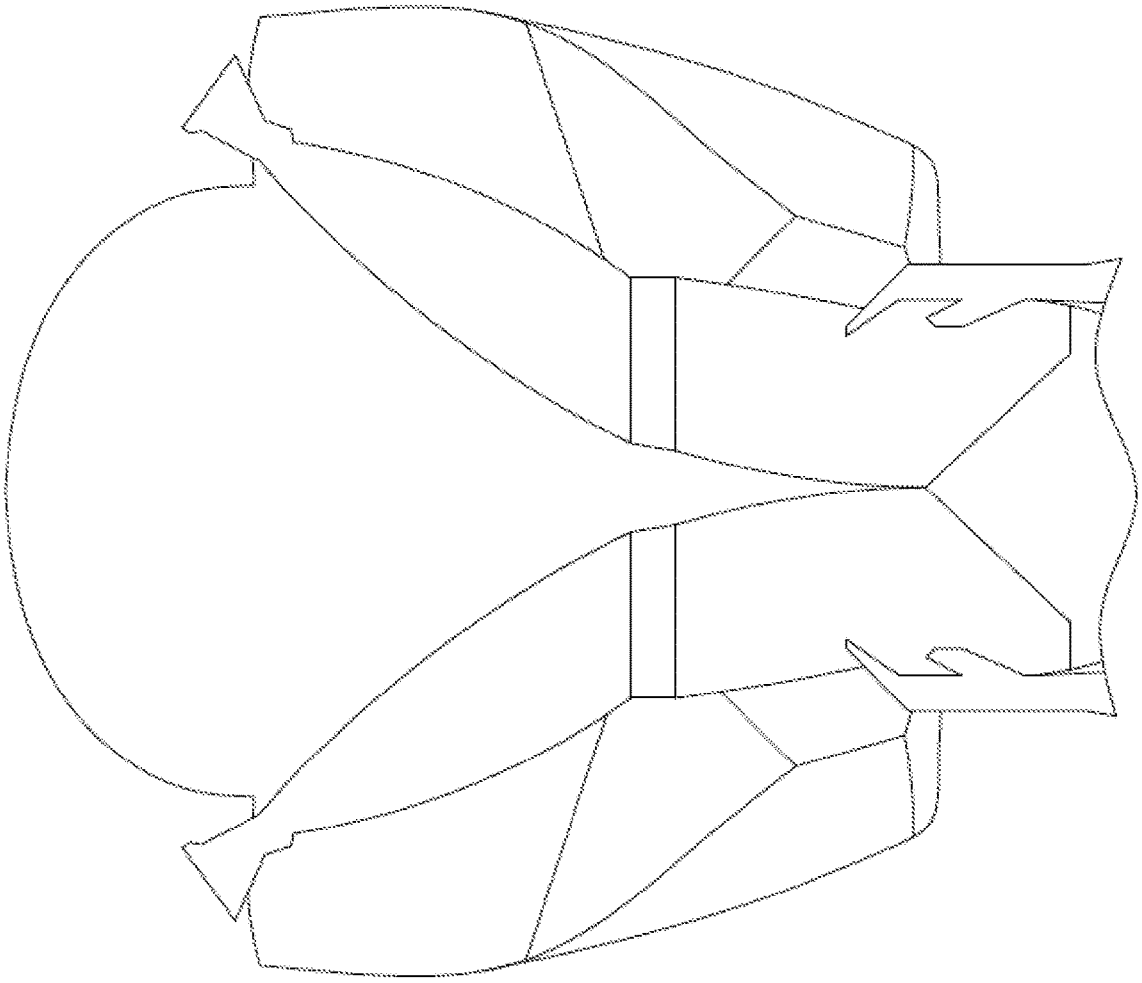
FIG. 9 is a view of the topside of the leg pillow, resting on its side showing a possible user's leg configuration.
Figure 13:
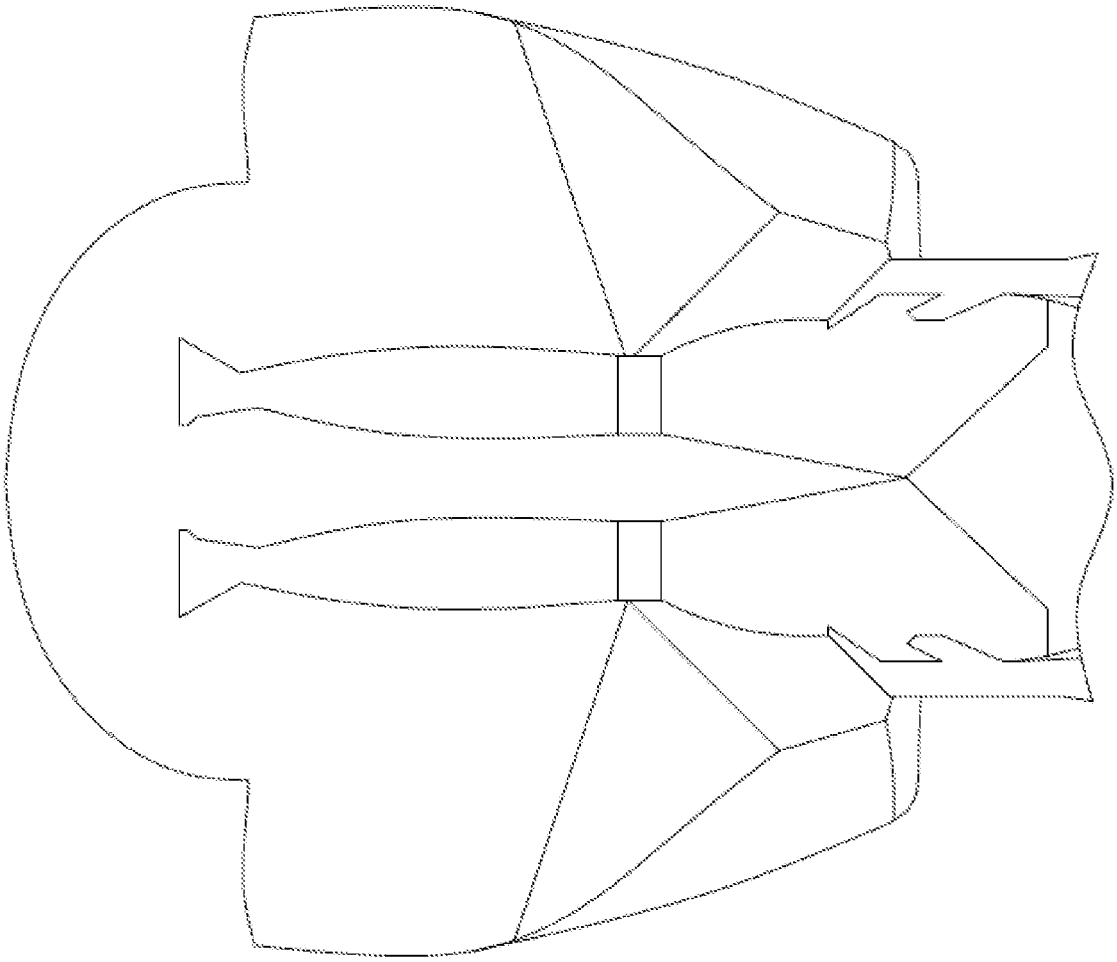
FIG. 13 is a view of the topside of the leg pillow, resting on its side showing a possible user's leg configuration.

The present application discloses a leg pillow to aid with sleeping. FIG. 1 shows a perspective view of the top and side. The user may use the pillow in at least three different orientations. In the regular orientation, the pillow operates as a leg pillow. The user may lie in the supine position with its hips at the proximal side, 102, and place its legs between the lateral risers, 104, and feet in the foot cutouts, 103. The user is shown using the pillow in this configuration in FIG. 9 and FIG. 13. The leg pillow is a wedge shape that elevates the feet and legs for enhanced comfort and circulation. See FIG. 3. The user also may choose to place its feet in the middle of the pillow between the foot cutouts, 103, specifically shown in FIG. 13. The lateral risers, 104, keep the legs from falling off the sides of the pillow.

Figure 10:
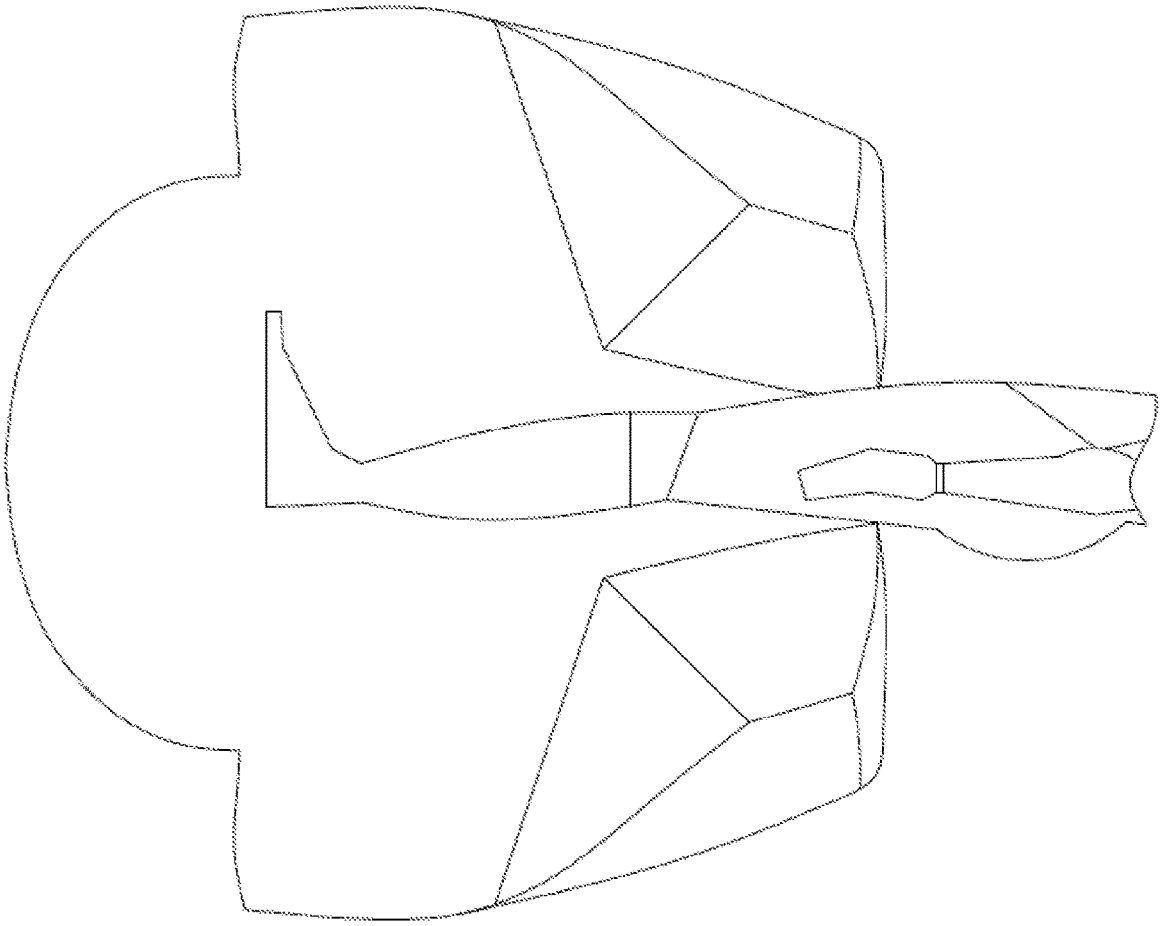
FIG. 10 is a view of the topside of the leg pillow, resting on its side showing a possible user's leg configuration.
Figure 11:
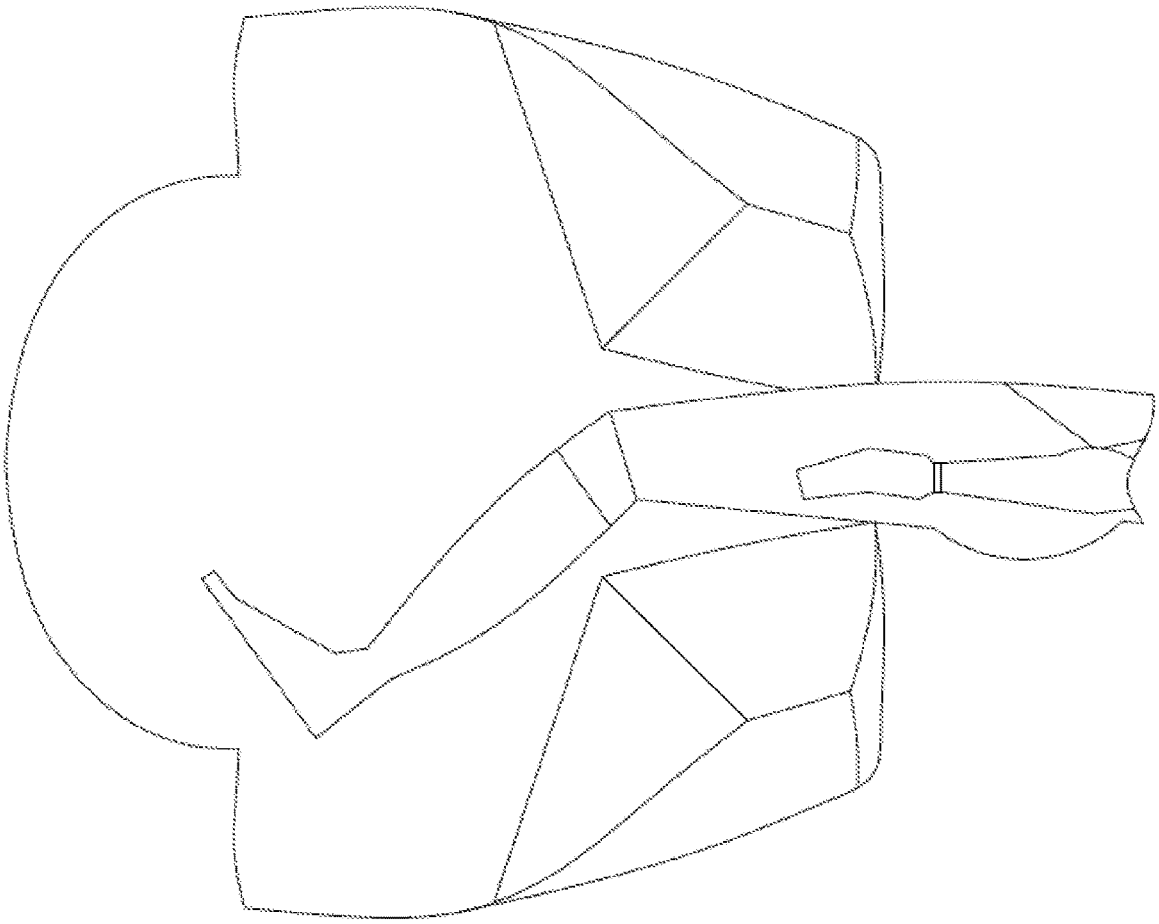
FIG. 11 is a view of the topside of the leg pillow, resting on its side showing a possible user's leg configuration.
Figure 12:
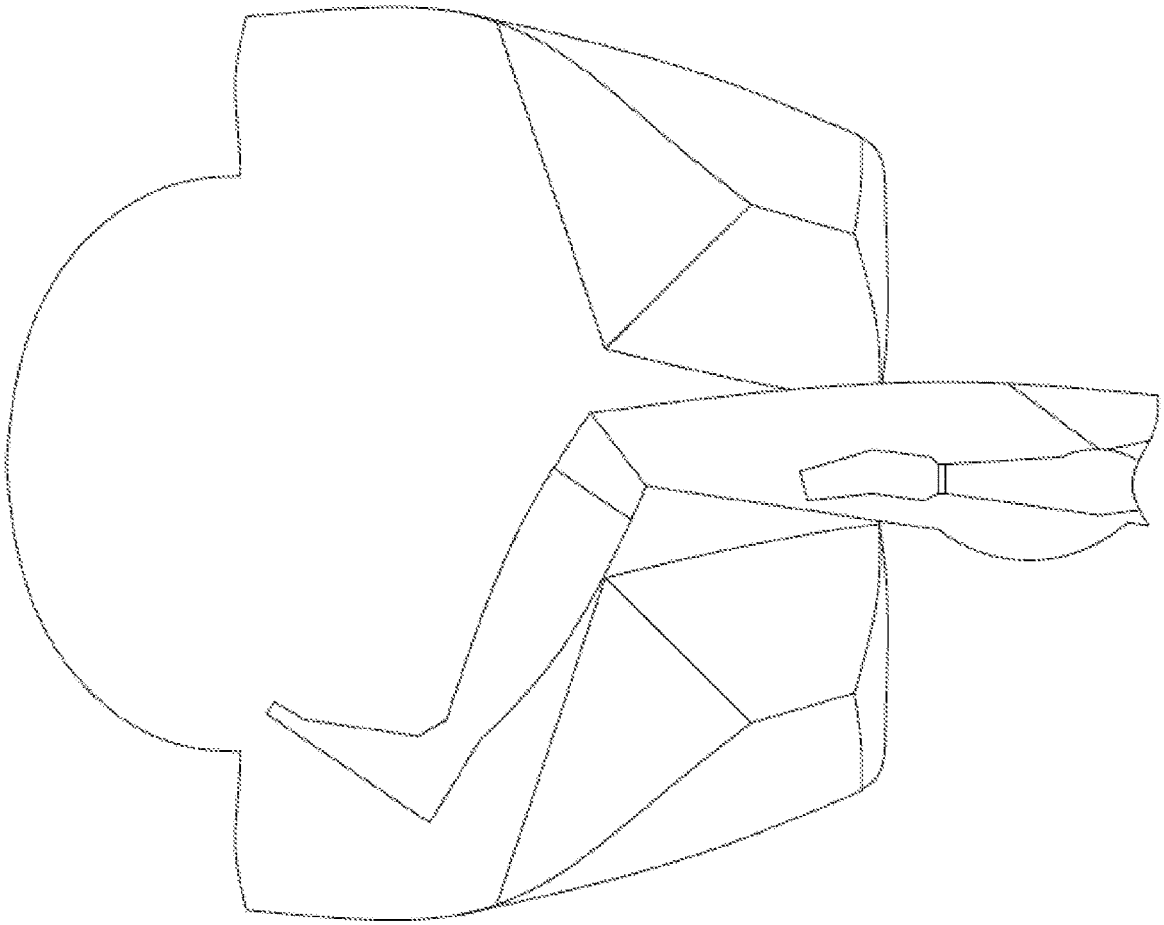
FIG. 12 is a view of the topside of the leg pillow, resting on its side showing a possible user's leg configuration.

In a second leg pillow orientation, the user may choose to straddle the pillow by moving its leg over the lateral riser, 104, and to the underside of the pillow. The user is shown using the pillow in this configuration in FIG. 10, FIG. 11, and FIG. 12. The pillow is rounded in order for the pillow to roll on its side. The rounded sections are shown at 105. In this position, one of the user's legs is elevated between lateral risers, 104.

In the third orientation, the pillow operates as a back pillow. The user leans back against the pillow with its head at the distal side, 101. The user's head is thus elevated due to the wedge shape of the pillow, shown clearly in FIG. 3. The lateral risers, 104, function more as armrests in this position. The user may also lie on its side using the pillow as a back pillow.

Figure 14:
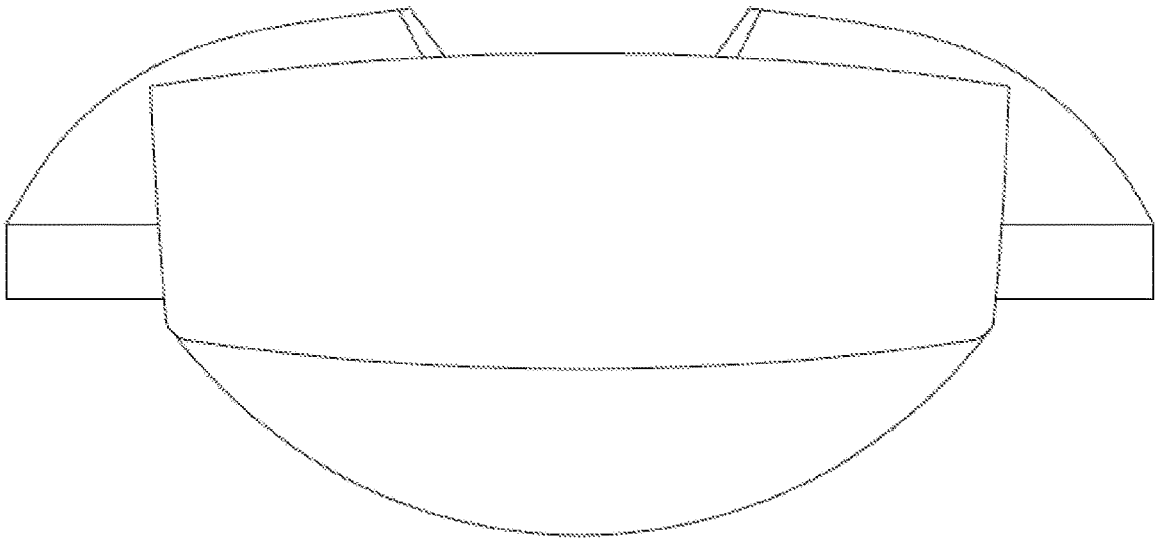
FIG. 14 is a side view of the distal side of another embodiment of the leg pillow.
Figure 15:
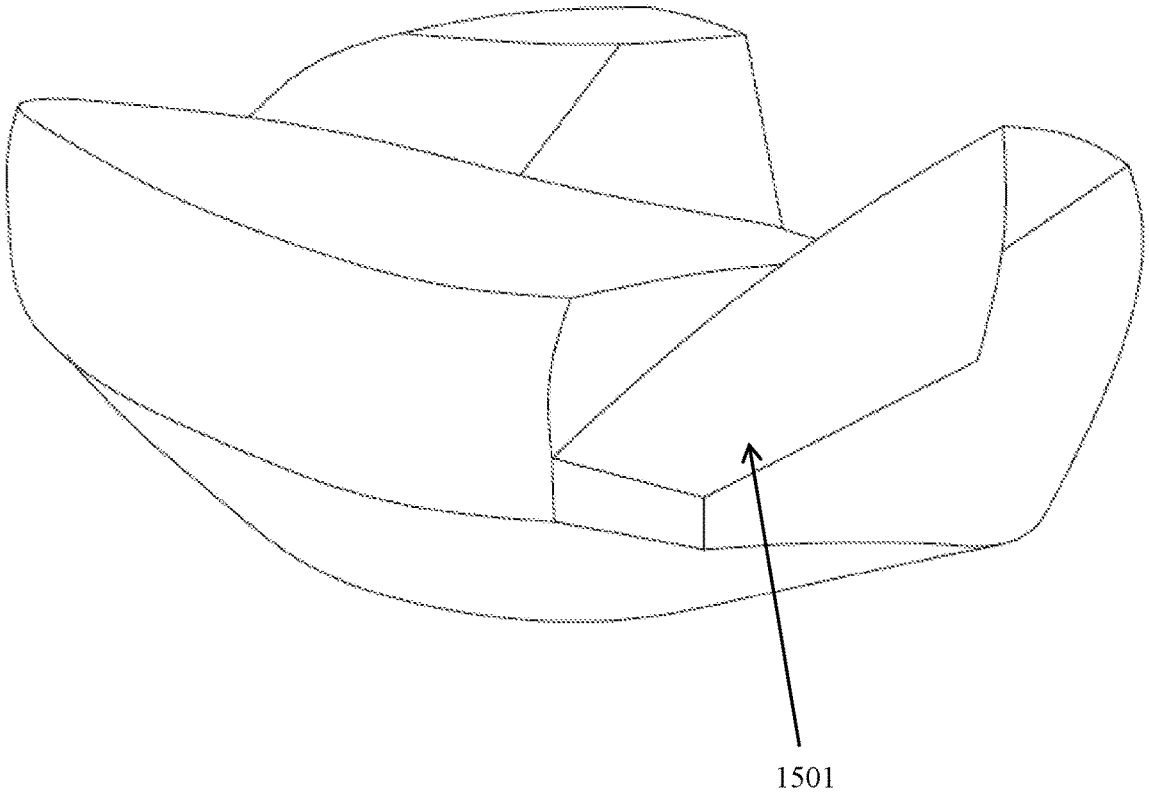
FIG. 15 is a perspective view of the embodiment shown in FIG. 14.

FIG. 14 and FIG. 15 show another embodiment with cutouts, shown as 1501 on FIG. 15, for the lower legs and feet. This variation allows the user to bend their knees even more in the supine position which may be more comfortable for that user. With the knees bent more, the legs and feet (in the supine position) can better grip the pillow which can help move it around to adjust the pillow's placement. The pillow may otherwise be similar to other embodiments shown.

General Shape

Figure 5:
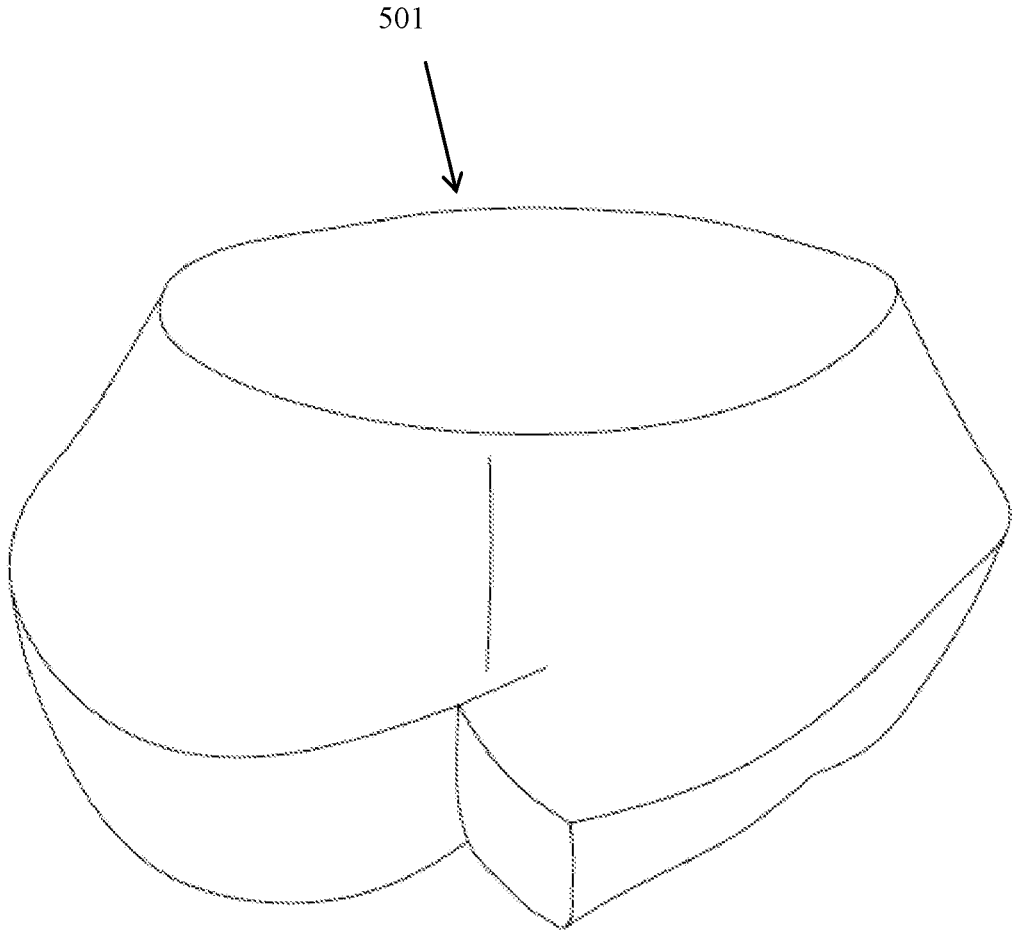
FIG. 5 is a perspective view of the leg pillow upside down.
Figure 6:
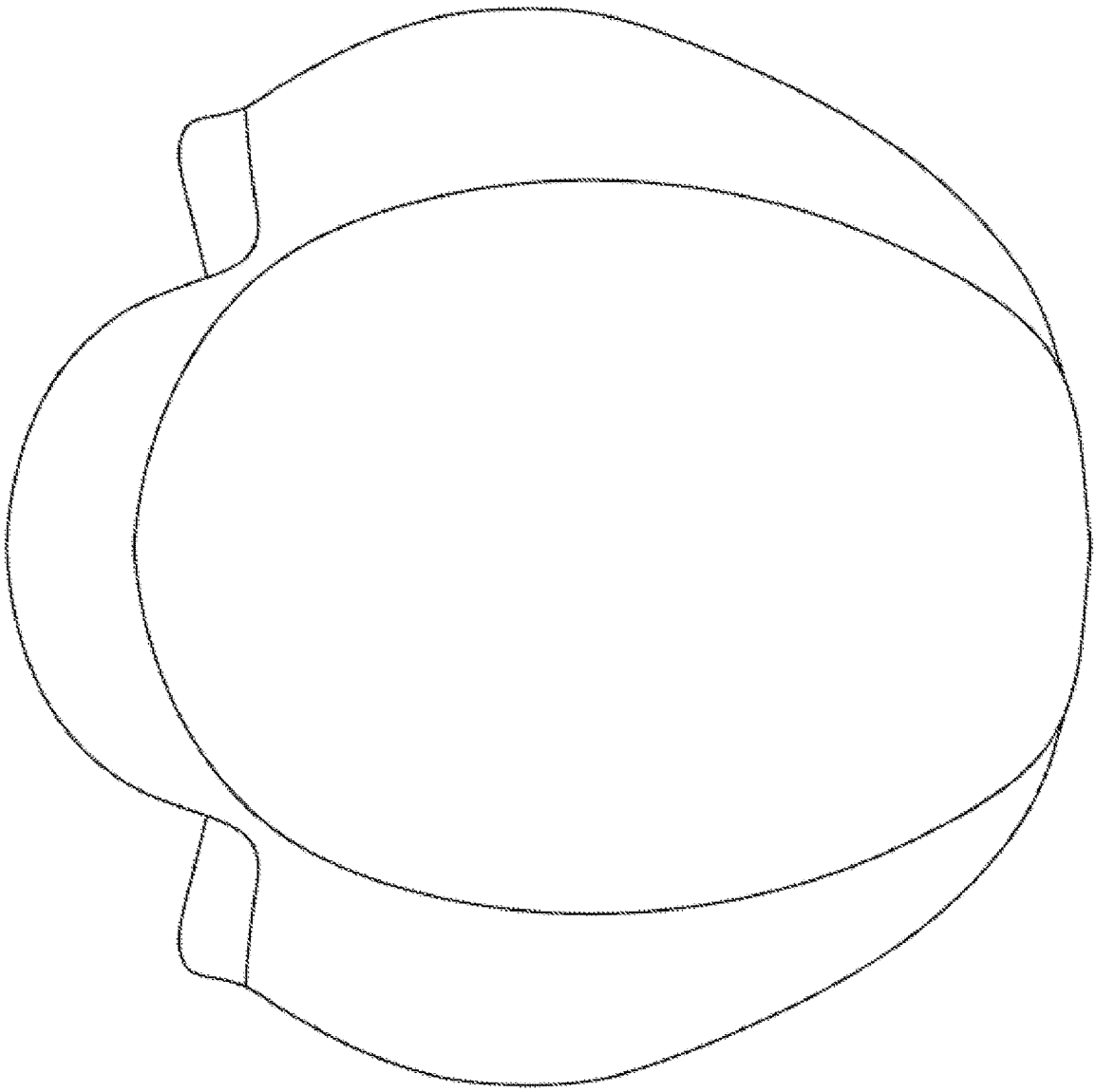
FIG. 6 is a view of the underside of the leg pillow, resting on its side.
Figure 7:
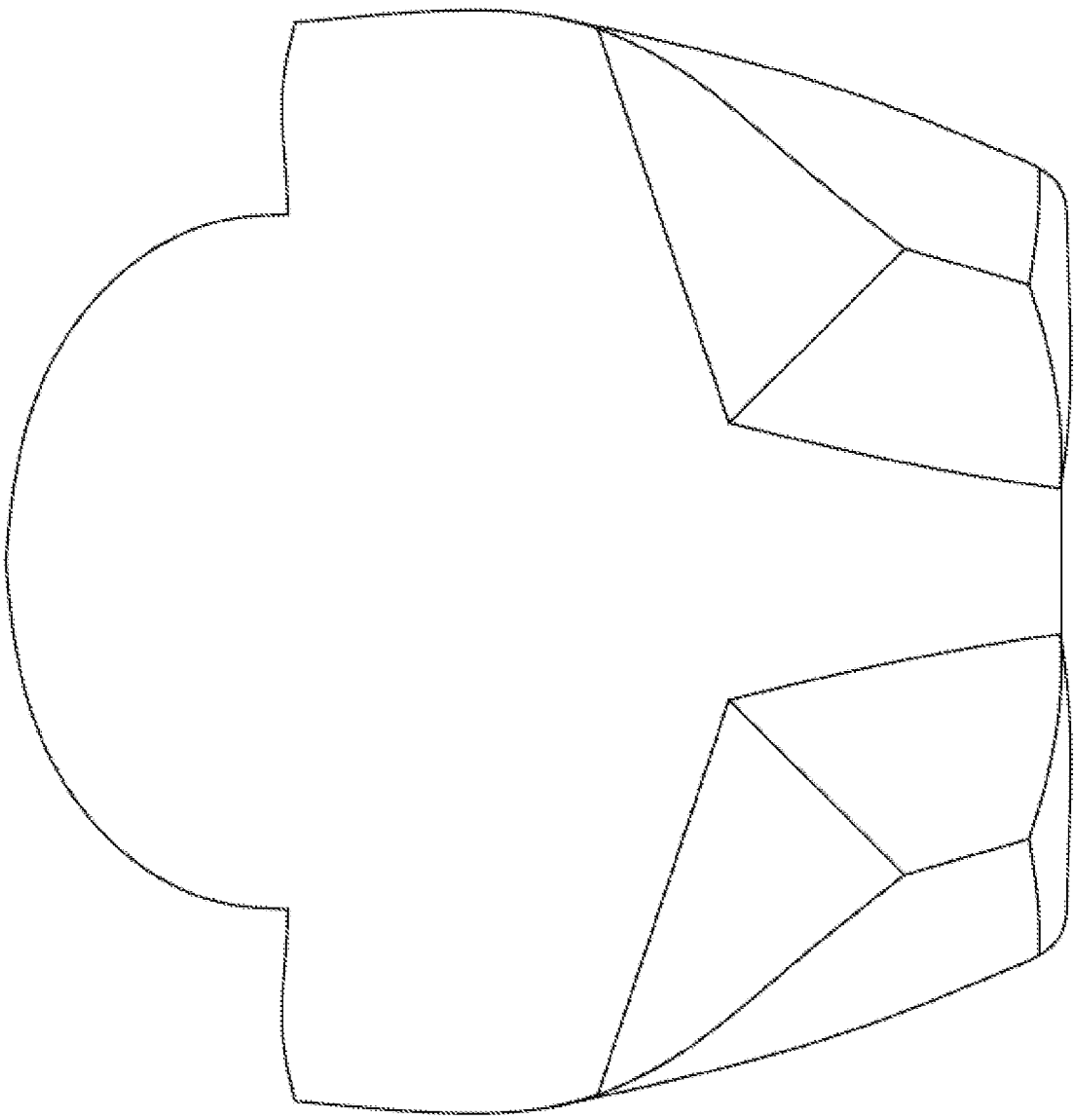
FIG. 7 is a view of the topside of the leg pillow, resting on its side.
Figure 8:
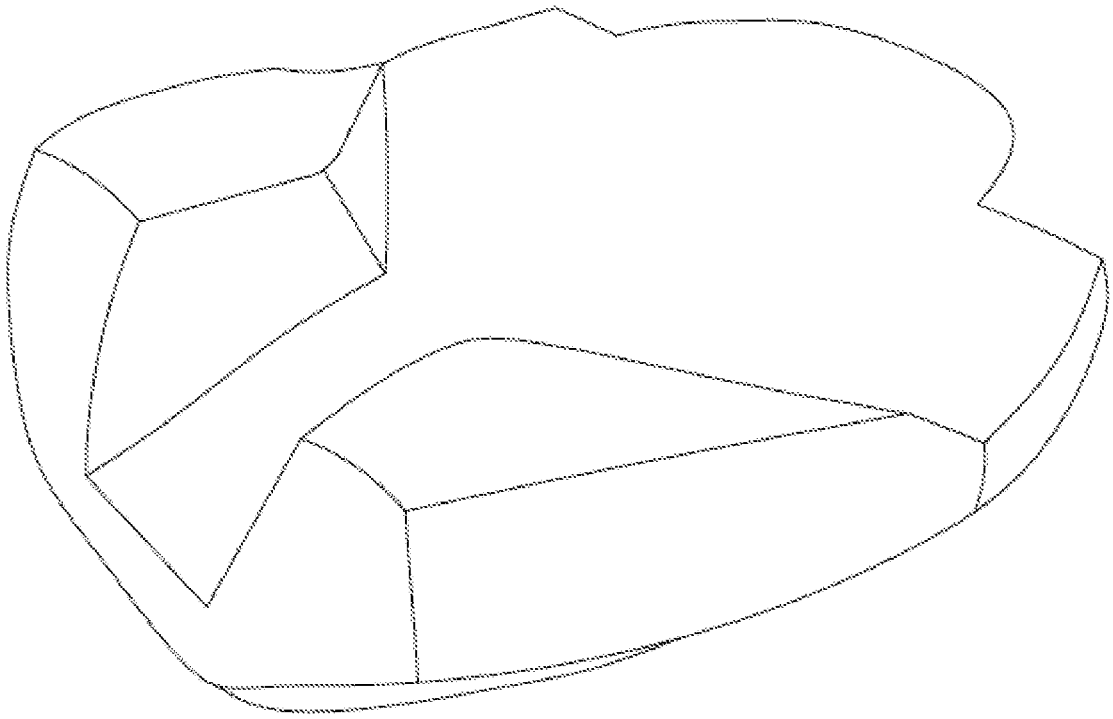
FIG. 8 is an unlabeled perspective view of the top and side.

The present invention has multiple embodiments which result in multiple shapes, and variation of those shapes, possibly based on user preference. Generally, the shape of the leg pillow is a wedge and circular segment at the distal side, 101. The circular segment exists generally at the foot side of the pillow, to cut down on bulk where the feet could not reach the corners, if they existed. Generally, the pillow slopes down on either side of the circular segment to form the foot cutouts, 103. Generally, the pillow is flat on the underside, 501, shown in FIG. 5.

Shape Variations

The pillow may be designed in a variety of dimensions. Smaller dimensions may generally be desired by smaller-bodied users. Additionally, the dimensions may account for particular sleeping patterns or disorders. Specifically, for example, a person who is more likely to have poor circulation may use a pillow with a thicker wedge, to increase the elevation of the legs. A pillow may also be designed to be wider or narrower, to reduce or promote the user from rolling onto its side. A narrower pillow may also allow two users on a single bed to each have a pillow. A longer pillow may allow a user's legs to have more support in the supine position, and a shorter pillow would allow less support.

There may be variations to the bottom side of the leg pillow to allow users to transit between different sleeping positions. The bottom side may be completely flat to discourage transiting positions. Alternatively, the bottom side edges may be rounded slightly or it could be completely rounded to encourage transiting positions. Certain areas may be rounded more than others according to the user's preference. For example, the outer edges proximal to the user's body may be rounded. The distal side may be rounded. The outer edges of the distal side may be rounded. The proximal edge and distal edge may only be rounded. Or any combination of the proceeding may be configured to the user's preference.

Materials

The present invention may be made of several materials. The pillow may be completely inflatable, or may be inflatable except for the lateral risers, 104. This may facilitate ease or cost of manufacture. The pillow may also have an inflatable core, but foam layer for comfort. The lateral and distal sides may not need foam because they have little to no contact with the user and reducing foam may reduce size and weight. The rounded sections, 105, may also be made without foam to make the transition easier for the bottom leg to slide under the pillow. A firmer surface on the proximal sides, 102, reduces the likelihood that the bottom leg will compress the proximal sides and not easily slide underneath because the leg is pushing and compressing into the pillow possibly causing it to snag.

An inflatable pillow may also benefit from being lightweight and having an adjustable firmness. An inflatable pillow may be useful because it may be more compact when stored deflated. Baffles may be necessary to ensure proper shape.

The leg pillow may have an inner rigid core such as plastic, carbon fiber, or metal, rigid foam or any other suitable material. A rigid core may prevent distortion of the pillow during use. A rigid core may also aid a user performing yoga or physical therapy, where the stresses on the pillow are higher than use for sleep. A rigid core pillow with leg restraint straps for surgery or mental patients may also be more suited than a pillow with no internal frame or a soft core.

Rather than a foam outer layer, rubber, gel, polyurethane foam, latex, memory foam, or closed cell foam, or no layer (hard plastic, for example) may be suitable in different applications, for example, chiropractic care, physical therapy, or yoga.

Pillows may have a shredded foam core, flexible polyurethane foam, latex foam, open or closed cell foam, rigid, semi-rigid, or flexible foam, cotton, wool, rubber, gel, wood, metal, plastic, carbon fiber, memory foam core, or any other suitable material. An optional pillow case may be made of cotton, wool, nylon, polyester, any blend thereof, leather, canvas, or any other suitable material. The pillow may have batting bonded to it.

Internal Rigid Frame

The leg pillow may have storage compartments built in. A pillow case may also have pouches attached to it for storage.

Firmer foam may be required on certain parts of the leg pillow. For example, the lateral risers, 104, may be made of firmer foam to prevent them from collapsing downward or outward.

Additions

The leg pillow may be outfitted with optional accessories. Some of those accessories are described below.

Detachable Tray

The leg pillow may have flexible brackets to allow the attachment of accessories. Gooseneck flexible tubing may fit into the flexible brackets to allow mounting some of these accessories. For example, a tray may have gooseneck tubing attached to it which may fit into flexible brackets. The tray may also attach using hook and loop fasteners, magnets, or buckles. The tray may be appropriated designed to hold electronics, a book holder, a small fan, or other suitable device. The tray may have raised edges to prevent items from sliding off of it. The tray may have a storage compartment underneath. The brackets or gooseneck flexible tubing may allow the tray or any other accessory to be tilted to the most comfortable position for the user. Alternatively, a bar mounted to each lateral riser, 104, may also attach to a tray or other suitable accessory.

The flexible bracket may also fit a reading light, possibly mounted to the end of gooseneck flexible tubing. The flexible bracket may be positioned on the lateral risers, 104. In this configuration, the user may turn the leg pillow around and use it as a back pillow. The lateral risers then become natural armrests. The lateral risers, 104, may also have cup holders built in.

The leg pillow may also have erotic stimulators built in to the narrow area between the lateral risers, 104. The erotic stimulator may be design for use by either male or female users. It may be detachable and may vibrate or have a variety of motions. The erotic stimulator may be positioned in a variety of ways, including sideways into the pillow. An optional pillow case may be designed so that detachment or use is accessible. The erotic stimulator may attach to a frame of the pillow, or to a plate inserted therein to maintain its position. Absorbent pads or liquid barriers may also be employed.

Flatulence Displacer

The leg pillow may have a system to displace flatulence built in. The system may comprise a vacuum pump, tubes, and a sensor. The vacuum pump may be built into the leg pillow or may be external, even in another room. Tubes may be built into the pillow, beginning at the proximal side, 102, and extending outside of a bed or bedroom. A vacuum pump may be attached to the tubes to expel gasses. A sensor may be employed to detect sound or gas, or the system may be activated manually.

Bed Mount

The distal side of the leg pillow, 101, may have a bracket to attach it to a foot board or foot end of a mattress. This bracket system would keep the pillow from sliding around the bed, or sliding down the bed if the foot side of the bed is inclined. The bracket may also elevate the pillow to help the legs slide under the pillow when transitioning from the supine to lateral sleep position.

Distal Elevating Bar

The leg pillow may have brackets to attach a distal elevating bar at the distal end, 101. The bar may lift the blanket over the feet to prevent the blanket from applying pressure to the feet. The distal elevating bar also prevents the feet and legs from snagging on the blanket or sheets. The distal elevating bar may also have clips or clamps to keep the blanket in the correct position.

Lateral Undercut Side Material

A smooth layer such as leather, vinyl, or any suitable coating may be applied to the lateral undercut sides, 105. This may facilitate the legs rubbing against the pillow when transitioning from the supine to lateral sleeping position.

Leg Straps

Restraint straps may be placed anywhere on the pillow to restrain the legs, for example, after surgery, for mental patients, or criminal arrest.

Temperature Control

Heating and cooling elements may be positioned internally or externally.

Massager

The leg pillow may have an internal or external massager. The massager may be built in to the pillow cover. The massager may be motorized, mechanical, or a simple vibration.

Handles

The leg pillow may have straps, handles, or cords on the sides for moving the pillow, for sexual purposes, or for adjusting the pillow.

Built in Alarm Clock and Radio

An alarm clock or radio may be built in to the leg pillow and pillow case. It may also attach to a detachable tray.

Armrest Extension

Armrest extensions may be available to attach to optional brackets. The armrests may be most effective when the leg pillow is used in the reverse position as a back pillow. The armrest may then attach to the lateral risers, 104.

Internal Rigid Frame

Rather than a foam or plastic core, the leg pillow may have an internal rigid or semi-rigid frame. This frame may be made of rods, tubes, plates, or other similar structures. The frame may be made of metal, plastic, composite, or any other suitable material. The frame may prevent the pillow of sagging, bowing, or warping during use. Raised areas, such has the lateral risers, 104, may especially benefit from an internal rigid frame.

The frame may be covered in a rubber coating to prevent it from penetrating outside of the leg pillow, or damaging the foam around the frame. If the frame is made of a tubing, it can aid in ventilating the pillow which may help keep the user of the pillow at a cooler temperature.

The pillow may also have an external frame around the far and lateral sides which do not come in contact with the user. This frame may be rods or flat bars.

Covers

The leg pillow may have an optional pillow case. The case may be designed around the brackets for accessories and may have storage pouches. A cover may optionally be waterproof for protection against spills or bodily fluids. A cover may have no bottom to it to prevent it from trapping air. A cover without a bottom may have an elastic band to secure it in place.

The pillow case may also be non-waterproof fabrics such as cotton, wool, nylon, spandex, polyester, vinyl, leather, or any other suitable material.

REFERENCES

U.S. Pat. Nos. 4,584,730; 4,889,109; 4,901,384; 4,910,818; 5,125,123; 5,871,457; 6,032,669; 5,878,453; 6,438,779; 7,150,057; US20140190488A1; US2014/0259425A1.

The invention claimed is:

1. A pillow designed to be used between a user's legs in a lateral position or under the user's legs in a supine position comprising: a wedge shape, narrow at the side configured to be proximal to the user's body and thicker at the side configured to be distal to the user's body; raised lateral portions, running less than two-thirds of the length of the pillow, disposed only on outer edges of a top side of the pillow on a side configured to be proximal to the user's body; a flat underside with rounded edges to allow the pillow to roll from the supine position to the lateral position, while also creating space for the user's bottom leg to occupy in the lateral position.

2. The pillow of claim 1 further comprising: cutouts for the user's feet disposed on the outer edges of a top side of the pillow at the side configured to be distal to the user's body.

3. The pillow of claim 2 further comprising: a flat underside, but without rounded edges, to allow the pillow to roll between the user's supine position to the user's lateral position.

4. The pillow of claim 1 further comprising: cutouts for the user's legs disposed on the distal side of the raised lateral portions outer edges of a top side of the pillow at the side configured to be distal to the user's body.

5. The pillow of claim 2 further comprising: cutouts for the user's lower legs disposed on the distal side of the raised lateral portions at the outer edges on a top side.

6. A method of using the leg pillow according to claim 1, where the user may configure or reconfigure said pillow to be either: under the user's legs in a supine position, or between the user's legs in a lateral position.

* * * * *